US006073559A

United States Patent [19]

Ellis

[11] Patent Number: 6,073,559

[45] Date of Patent: Jun. 13, 2000

[54] LITHOGRAPHIC IMAGING WITH CONSTRUCTIONS HAVING INORGANIC OLEOPHILIC LAYERS

[75] Inventor: Ernest W. Ellis, Harvard, Mass.

[73] Assignee: Presstek, Inc., Hudson, N.H.

[21] Appl. No.: 09/151,497

[22] Filed: Sep. 11, 1998

[51] Int. Cl.[7] ..... B41N 1/14

[52] U.S. Cl. ..... 101/454; 101/458; 101/467

[58] Field of Search ..... 101/453, 454, 101/455, 458, 459, 465, 466, 467; 430/302, 303

[56] References Cited

U.S. PATENT DOCUMENTS

| | | | |
|---|---|---|---|
| Re. 35,512 | 5/1997 | Nowak et al. | 101/454 |
| 3,996,057 | 12/1976 | Kawaziri et al. | 101/467 |
| 4,214,249 | 7/1980 | Kasai et al. | 101/467 |
| 5,339,737 | 8/1994 | Lewis et al. | 101/453 |
| 5,783,364 | 7/1998 | Ellis et al. | 430/302 |
| 5,786,129 | 7/1998 | Ellis | 430/302 |
| 5,807,658 | 9/1998 | Ellis et al. | 101/467 |
| 5,906,909 | 5/1999 | Ellis | 101/456 |
| 5,916,734 | 6/1999 | Takagami et al. | 430/302 |
| 5,927,207 | 7/1999 | Ghosh et al. | 101/467 |

FOREIGN PATENT DOCUMENTS

| | | | |
|---|---|---|---|
| 3507 | 1/1982 | Japan | 101/467 |

*Primary Examiner*—Stephen R. Funk
*Attorney, Agent, or Firm*—Cesari and McKenna, LLP

[57] ABSTRACT

Lithographic printing members utilize, as an ink-accepting layer, a hard, inorganic, and generally covalent material that exhibits sufficient flexibility (at the deposition thicknesses envisioned) to accommodate flexing and bending. This layer may overlie a relatively heavy, metal plate substrate or support, resulting in a structure whose permanent layers all share the physical properties of inorganic materials. The printing member may also be provided with a protective layer that serves a variety of beneficial functions, including protection against handling and environmental damage and extension of plate shelf life, but which also is removed during the printing make-ready process.

58 Claims, 1 Drawing Sheet

LITHOGRAPHIC IMAGING WITH CONSTRUCTIONS HAVING INORGANIC OLEOPHILIC LAYERS

BACKGROUND OF THE INVENTION

1. Field of the Invention

The present invention relates to digital printing apparatus and methods, and more particularly to imaging of lithographic printing-plate constructions on- or off-press using digitally controlled laser output.

2. Description of the Related Art

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening fluid to the plate prior to inking. The dampening fluid prevents ink from adhering to the non-image areas, but does not affect the oleophilic character of the image areas.

To circumvent the cumbersome photographic development, plate-mounting and plate-registration operations that typify traditional printing technologies, practitioners have developed electronic alternatives that store the imagewise pattern in digital form and impress the pattern directly onto the plate. Plate-imaging devices amenable to computer control include various forms of lasers.

For example, U.S. Pat. Nos. 5,783,364 and 5,807,658 the entire disclosures of which are hereby incorporated by reference, describe a variety of lithographic plate configurations for use with such imaging apparatus. In general, the plate constructions include an inorganic layer (i.e., a metal, combination of metals, or a metal/non-metal compound) situated on an organic polymeric layer. The inorganic layer ablates in response to imaging (e.g., infrared, or "IR") radiation. In one approach, the inorganic layer represents the topmost surface of the plate and accepts dampening fluid, while the underlying polymeric layer accepts ink. Application of an imaging pulse to a point on the plate ultimately creates an image spot having an affinity for a dampening fluid differing from that of unexposed areas, the pattern of such spots forming a lithographic plate image.

These types of plates can exhibit performance limitations, particularly after high numbers of impressions, owing to the abrupt transition between a hard inorganic layer and a soft organic, polymeric layer. The divergent physical and chemical characteristics of such distinct layers can compromise their anchorage to one another—a critical performance requirement—as well as the durability of the inorganic layer. For example, because inorganic and organic materials typically have very different coefficients of thermal expansion and elastic moduli, even perfectly adhered inorganic layers may undergo failure (e.g., fracturing) due to temperature variations or the stress of plate manipulation and use. The different responses of two adjacent layers to an external condition can easily cause damage that would not occur in either layer by itself.

To improve interlayer anchorage, polymeric layers may be selected (or applied as intermediate coatings) based on chemical compatibility with inorganic material. A polymeric layer may also be pretreated (e.g., through plasma exposure) to modify the surface for greater interfacial compatibility with a subsequently applied inorganic layer. These approaches, however, have limited utility in addressing the effects of transition between fundamentally different materials.

DESCRIPTION OF THE INVENTION

Brief Summary of the Invention

The present invention replaces the conventional polymeric ink-accepting layer with a hard, inorganic, and generally covalent material that exhibits sufficient flexibility (at the deposition thicknesses envisioned) to accommodate the flexing and bending required of lithographic printing plates. This plate layer may overlie a relatively heavy, metal plate substrate or support (although, again, one flexible enough to accommodate plate mounting and use), resulting in a structure whose permanent layers all share the physical properties of inorganic materials.

The plates may also be provided with a protective layer that serves a variety of beneficial functions, including protection against handling and environmental damage and extension of plate shelf life, but which also is removed during the printing make-ready process.

In general, the plate constructions of the present invention include a durable, hydrophilic ceramic layer; a hard, inorganic, oleophilic layer thereunder; and a substrate which, as noted above, may itself be metal. If a metal substrate is employed, the oleophilic layer provides sufficient thermal insulation to prevent substantial dissipation of heat—which is necessary to achieve ablation of the hydrophilic layer—into the substrate. Accordingly, in this context, the degree of thermal insulation afforded by the oleophilic layer is adequate if the imaging power necessary for ablation is comparable to that used in connection with plates having thermally non-conductive (e.g., polyester) substrates.

Preferred oleophilic layers are hard, adequately flexible at application thicknesses, thermally stable (exhibiting, for example, high melting points that prevent damage by imaging radiation), reflect or at least do not absorb imaging (e.g., infrared) radiation, and resist degradation by solvents typically used during press operation. Certain ceramic materials (as defined below) are suitable for this layer. An intermediate tying layer may be used to anchor a hydrophilic ceramic layer to the oleophilic layer.

It should be stressed that, as used herein, the term "plate" or "member" refers to any type of printing member or surface capable of recording an image defined by regions exhibiting differential affinities for ink and/or fountain solution; suitable configurations include the traditional planar or curved lithographic plates that are mounted on the plate cylinder of a printing press, but can also include seamless cylinders (e.g., the roll surface of a plate cylinder), an endless belt, or other arrangement.

Furthermore, the term "hydrophilic" is used in the printing sense to connote a surface affinity for a fluid which prevents ink from adhering thereto. Such fluids include water for conventional ink systems, aqueous and non-aqueous dampening liquids, and the non-ink phase of single-fluid ink systems. Thus, a hydrophilic surface in accordance herewith exhibits preferential affinity for any of these materials relative to oil-based materials.

BRIEF DESCRIPTION OF THE DRAWING

The foregoing discussion will be understood more readily from the following detailed description of the invention, when taken in conjunction with FIG. 1 which depicts an enlarged sectional view of a recording construction in accordance with the present invention.

DETAILED DESCRIPTION OF THE PREFERRED EMBODIMENTS

Figure 1:
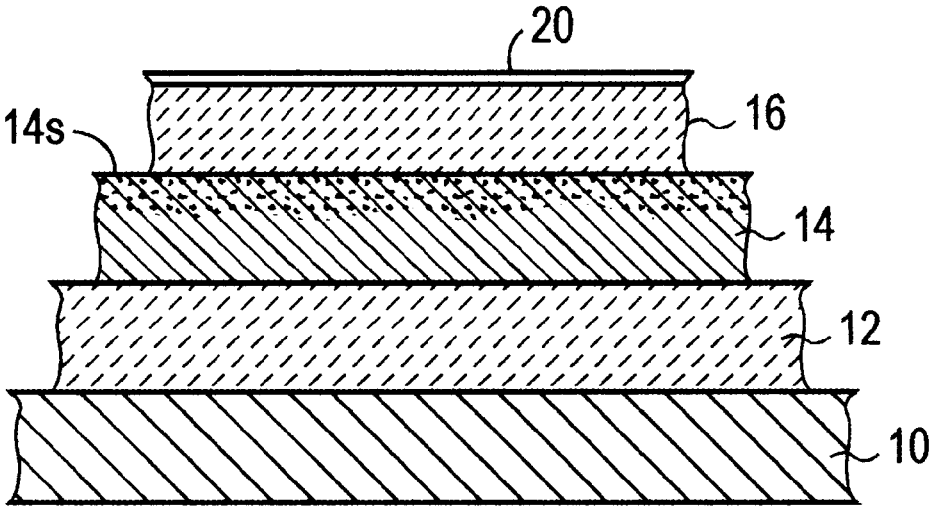

Imaging apparatus suitable for use in conjunction with the present printing members includes at least one laser device that emits in the region of maximum plate responsiveness, i.e., whose $lambda_{max}$ closely approximates the wavelength region where the plate absorbs most strongly. Specifications for lasers that emit in the near-IR region are fully described in U.S. Pat. Nos. Re. 35,512 and 5,385,092 (the entire disclosure of which is hereby incorporated by reference); lasers emitting in other regions of the electromagnetic spectrum are well-known to those skilled in the art.

Suitable imaging configurations are also set forth in detail in the '512 and '092 patents. Briefly, laser output can be provided directly to the plate surface via lenses or other beam-guiding components, or transmitted to the surface of a blank printing plate from a remotely sited laser using a fiber-optic cable. A controller and associated positioning hardware maintains the beam output at a precise orientation with respect to the plate surface, scans the output over the surface, and activates the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor (RIP) or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

The imaging apparatus can operate on its own, functioning solely as a platemaker, or can be incorporated directly into a lithographic printing press. In the latter case, printing may commence immediately after application of the image to a blank plate, thereby reducing press set-up time considerably. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate.

In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Regardless of the manner in which the beam is scanned, it is generally preferable (for on-press applications) to employ a plurality of lasers and guide their outputs to a single writing array. The writing array is then indexed, after completion of each pass across or along the plate, a distance determined by the number of beams emanating from the array, and by the desired resolution (i.e., the number of image points per unit length). Off-press applications, which can be designed to accommodate very rapid plate movement (e.g., through use of high-speed motors) and thereby utilize high laser pulse rates, can frequently utilize a single laser as an imaging source.

With reference to FIG. 1, a representative plate construction includes a hard substrate 10, a hard ceramic layer 12, a tying layer 14, and a hydrophilic, metallic inorganic layer 16. Substrate 10 is hard, strong, stable and flexible, and is preferably a metal sheet. Preferred metal substrates have thicknesses of 0.005 inch or more. For example, the aluminum coil traditionally employed to produce textured-surface plates (by graining and anodizing) can be used.

Alternatively, substrate 10 may be a multilayer composite including a relatively thin foil layer (in order to ease application of the overlying layers) laminated to a heavier metal substrate. Suitable techniques of lamination are described, for example, in U.S. Pat. No. 5,188,032, and in the '512 and '092 patents.

Layer 12 is oleophilic, hard, and flexible enough to permit normal handling and mounting procedures at the envisioned deposition thicknesses. If substrate 10 is thermally conductive, layer 12 should also provide a thermal barrier, preventing significant dissipation of heat into substrate 10. Without sufficient insulation, at least some of the energy delivered by the imaging device will leave layers 14, 16 before the catastrophic overheating that characterizes ablation is achieved, thereby increasing imaging power requirements or preventing ablation altogether.

In addition to shielding the passage of heat, layer 12 should resist the action of the imaging process as well as the rigors of printing. During imaging, layer 12 must maintain its own internal integrity notwithstanding the application of radiation to overlying plate layers 14, 16, as well as the evolution of thermal energy from ablation of those layers. Thus, the material of layer 12 must have a high enough melting point to withstand the heat to which it is exposed, and ideally also reflects imaging radiation so as not to be affected by radiation that passes, unabsorbed, through layers 16, 14. The more inherently hard and durable the material of layer 12, the smaller will be the required deposition thickness. Generally, layer 12 is deposited at a thickness of at least 500 Å.

During printing, layer 12 should not degrade despite repeated exposure to press solvents (fountain solution, ink-borne solvents, etc.) throughout the expected useful life of the plate. Similarly, layer 12 must be sufficiently refractory to withstand the repeated mechanical stresses of the printing process.

Finally, if layers 14, 16 are applied by a vacuum process, manufacturing efficiencies favor the ability to apply layer 12 by a vacuum process (e.g., sputtering or reactive sputtering) as well. But other processes, such as flame spraying (see *Handbook of Thin Film Process Technology*, IOP Publishing 1995), may also be employed to advantage.

Preferred materials for layer 12 include ceramics, a class of material which, for purposes hereof, is intended to connote refractory oxides, carbides, and nitrides of metals or nonmetals. These materials are typically covalent in nature, and have both high melting points (generally 1900° C. or higher) and high Young's moduli (typically 200 kN/mm$^2$ or higher). Moreover, in ceramic materials the high values of Young's modulus are preserved up to high temperatures approaching the melting point. Representative ceramics include such covalent hard materials as $B_4C$, BN, $AlB_{12}$, SiC, $SiB_6$, $Si_3N_4$, and AlN, among others. Suitable materials may also include dopants, such as copper, to improve ink receptivity.

Layer 14, which is optional, is a a metal that may or may not develop a native oxide surface 14*s* upon exposure to air during the plate-fabrication process. The thickness of layer 14 depends on the application. If made too thin, the layer will not absorb sufficient radiation to undergo ablation; if too thick, it will reflect, rather than absorb, radiation and once again will fail to ablate. Generally layer 14 is applied at thicknesses of 50–5000 Å. Layer 14 functions as a tying layer if the surface characteristics of hard layer 12 are not well-suited to acceptance and anchorage of the metallic inorganic layer, and may otherwise be omitted. The metal of layer 14 is at least one d-block (transition) metal such as titanium, aluminum, indium or tin. In the case of a mixture, the metals are present as an alloy or an intermetallic. Oxidation can occur on both metal surfaces, and may also, therefore, affect adhesion of layer 14 to hard layer 12 (or other underlying layer).

Layer 16 is a metallic inorganic layer comprising a compound of at least one metal with at least one non-metal, or a mixture of such compounds. It is generally applied at a thickness of 100–5000 Å or greater; however, optimal thickness is determined primarily by durability concerns, and secondarily by economic considerations and convenience of application. The metal component of layer 16 may be a d-block (transition) metal, an f-block (lanthanide) metal, aluminum, indium or tin, or a mixture of any of the foregoing (an alloy or, in cases in which a more definite composition exists, an intermetallic). Preferred metals include titanium, zirconium, vanadium, niobium, tantalum, molybdenum and tungsten. The non-metal component of layer 16 may be one or more of the p-block elements boron, carbon, nitrogen, oxygen and silicon. A metal/non-metal compound in accordance herewith may or may not have a definite stoichiometry, and may in some cases (e.g., Al—Si compounds) be an alloy. Preferred metal/non-metal combinations include TiN, TiON, $TiO_x$ (where $0.9 \leqq x \leqq 2.0$), TiAlN, TiAlCN, TiC and TiCN.

A protective layer 20 may be deposited over metallic inorganic layer 16. If added, this layer can serve a variety of beneficial functions: providing protection against handling and environmental damage, and also extending plate shelf life, but disappearing during make-ready; assisting with cleaning by entraining debris and carrying it away as the layer itself is removed during press make-ready; acting as a debris-management barrier, preventing the accumulation of airborne debris that might interfere with unimaged areas and/or imaging optics; and exhibiting hydrophilicity (as that term is used in the printing industry, i.e., accepting fountain solution), thereby accelerating plate "roll-up"—that is, the number of preliminary impressions necessary to achieve proper quality of the printed image. Protective layer 20 performs these functions but disappears in the course of the normal "make-ready" process that includes roll-up—indeed, even accelerates that process.

Protective layer 20 preferably comprises a polyalkyl ether compound with a molecular weight that depends on the mode of application and the conditions of plate fabrication. For example, when applied as a liquid, the polyalkyl ether compound may have a relatively substantial average molecular weight (i.e., at least 600) if the plate undergoes heating during fabrication or experiences heat during storage or shipping; otherwise, lower molecular weights are acceptable. A coating liquid should also exhibit sufficient viscosity to facilitate even coating at application weights appropriate to the material to be coated.

A preferred formulation for aqueous coating 20 comprises 2.5 parts polyvinyl alcohol (e.g., the Airvol 203 product sold by Air Products and Chemicals, Allentown, Pa.) dispersed in 89.37 parts deionized water at room temperature using sufficient agitation to wet out all particles with water. The temperature of the dispersion is elevated to 85–96° C., and held for 30 min with continuous agitation. After the temperature of the resulting clear solution cools to room temperature, 0.13 parts diethyleneglycol and 8 parts methyl alcohol are added.

The solution is coated over a ceramic printing plate surface and dried to provide a protective layer at a thickness of about 0.2 to 0.4 $\mu$m.

More generally, the protective layer 20 is preferably applied at a minimal thickness consistent with its roles, i.e., providing protection against handling and environmental damage, extending plate shelf life by shielding the plate from airborne contaminants, and entraining debris produced by imaging. The thinner layer 20 can be made, the more quickly it will be removed during press make-ready, the shorter will be the roll-up time, and the less the layer will affect the imaging sensitivity of the plate.

It will therefore be seen that the foregoing techniques provide a basis for improved lithographic printing and superior plate constructions. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of imaging a lithographic printing member, the method comprising the steps of:

a. providing member having a printing surface and including a hydrophilic inorganic first layer, an inorganic, oleophilic second layer underlying the first layer comprising a ceramic comprising at least one of boron, silicon and nitrogen, an inorganic support under the second layer, the first layer, but not the second layer, being formed of a material subject to ablative absorption of imaging radiation;

b. selectively exposing, in a pattern representing an image, the printing surface to laser radiation so as to ablate the first layer but not the second layer; and c. removing remnants of the first layer where the printing member received radiation.

2. The method of claim 1 wherein the inorganic support comprises a metal, the oleophilic layer providing thermal insulation between the ablatable first layer and the inorganic support.

3. The method of claim 1 wherein the printing member further comprises a metal tying layer between the first and second layers.

4. The method of claim 3 wherein the metal layer comprises at least one of (i) a d-block transition metal, (ii) aluminum, (iii) indium and (iv) tin.

5. The method of claim 3 wherein the metal layer is titanium.

6. The method of claim 1 wherein the first layer comprises a compound of at least one metal with at least one non-metal, the at least one non-metal being selected from the group consisting of boron, carbon, nitrogen, silicon and oxygen.

7. The method of claim 6 wherein the first layer comprises at least one of (i) a d-block transition metal, (ii) an f-block lanthanide, (iii) aluminum, (iv) indium and (v) tin.

8. The method of claim 6 wherein the first layer comprises at least one of (i) titanium, (ii) zirconium, (iii) vanadium, (iv) niobium, (v) tantalum, (vi) molybdenum and (vii) tungsten.

9. The method of claim 6 wherein the second layer comprises a compound comprising boron.

10. The method of claim 6 wherein the second layer comprises a compound comprising carbon.

11. The method of claim 6 wherein the second layer comprises a compound comprising nitrogen.

12. The member of claim 6 wherein the first layer comprises a compound comprising carbon and nitrogen.

13. The method of claims 6 wherein the second layer comprises a compound comprising silicon.

14. The method of claim 6 wherein the first layer is TiN.

15. The method of claim 6 wherein the first layer is TiC.

16. The method of claim 6 wherein the first layer is TiCN.

17. The method of claim 6 wherein the first layer is $TiO_x$ (wherein $0.9 \leqq x \leqq 2.0$).

18. The method of claim 6 wherein the first layer is TiON.

19. The method of claim 6 wherein the first layer is TiAlN.

20. The method of claim 6 wherein the first layer is TiAlCN.

21. The method of claim 6 wherein the second layer comprises a compound comprising SiC.

22. The method of claim 3 wherein the second layer comprises a compound comprising $Si_3N_4$.

23. The method of claim 6 wherein the second layer comprises a compound comprising AlN.

24. The method of claim 1 wherein the second layer comprises a compound comprising boron.

25. The method of claim 24 wherein the compound is $B_4C$.

26. The method of claim 24 wherein the compound is BN.

27. The method of claim 24 wherein the compound is $AlB_{12}$.

28. The method of claim 24 wherein the compound is $SiB_6$.

29. The method of claim 1 wherein the printing member further comprises a hydrophilic barrier layer, removable by dampening fluid on the first layer.

30. A lithographic printing member comprising:

a. a hydrophilic, inorganic first layer;

b. an inorganic, oleophilic second layer underlying the first layer and comprising a ceramic comprising at least one of boron, silicon, and nitrogen; and c. an inorganic support under the second layer;

wherein d. the first layer, but not the second layer, ablatively absorbs imaging radiation.

31. The member of claim 30 wherein the inorganic support comprises a metal, the oleophilic layer providing thermal insulation between the ablatable first layer and the inorganic support.

32. The member of claim 30 further comprising a metal tying layer between the first and second layers.

33. The member of claim 32 wherein the metal layer comprises at least one of (i) a d-block transition metal, (ii) aluminum, (iii) indium and (iv) tin.

34. The member of claim 32 wherein the metal layer is titanium.

35. The member of claim 30 wherein the first layer comprises a compound of at least one metal with at least one non-metal, the at least one non-metal being selected from the group consisting of boron, carbon, nitrogen, silicon and oxygen.

36. The member of claim 35 wherein the first layer comprises at least one of (i) a d-block transition metal, (ii) an f-block lanthanide, (iii) aluminum, (iv) indium and (v) tin.

37. The member of claim 35 wherein the first layer comprises at least one of (i) titanium, (ii) zirconium, (iii) vanadium, (iv) niobium, (v) tantalum, (vi) molybdenum and (vii) tungsten.

38. The member of claim 35 wherein the second layer comprises a compound comprising boron.

39. The member of claim 35 wherein the second layer comprises a compound comprising carbon.

40. The member of claim 35 wherein the second layer comprises a compound comprising nitrogen.

41. The member of claim 35 wherein the first layer comprises a compound comprising carbon and nitrogen.

42. The member of claim 35 wherein the second layer comprises a compound comprising silicon.

43. The member of claim 35 wherein the first layer is TiN.

44. The member of claim 35 wherein the first layer is TiC.

45. The member of claim 35 wherein the first layer is TiCN.

46. The member of claim 35 wherein the first layer is $TiO_x$ ($0.9 \leqq x \leqq 2.0$).

47. The member of claim 35 wherein the first layer is TiON.

48. The member of claim 35 wherein the first layer is TiAlN.

49. The member of claim 35 wherein the first layer is TiAlCN.

50. The member of claim 35 wherein the second layer comprises a compound comprising SiC.

51. The member of claim 35 wherein the second layer comprises a compound comprising $Si_3N_4$.

52. The member of claim 35 wherein the second layer comprises a compound comprising AlN.

53. The member of claim 30 wherein the second layer comprises a compound comprising boron.

54. The member of claim 53 wherein the compound is $B_4C$.

55. The member of claim 53 wherein the compound is BN.

56. The member of claim 53 wherein the compound is $AlB_{12}$.

57. The member of claim 53 wherein the compound is $SiB_6$.

58. The member of claim 30 wherein the printing member further comprises a hydrophilic barrier layer, removable by dampening fluid, on the first layer.

* * * * *